US006070511A

United States Patent [19]

Palmer et al.

[11] Patent Number: 6,070,511

[45] Date of Patent: Jun. 6, 2000

[54] APPARATUS AND PROCESS FOR LOADING EMULSION EXPLOSIVES

[75] Inventors: Anthony Martin Palmer, Hillsborough; Stephen Thomson, Merewether, both of Australia

[73] Assignee: Orica Explosives Technology Pty Ltd, Melbourne, Australia

[21] Appl. No.: 08/817,734

[22] PCT Filed: Oct. 13, 1995

[86] PCT No.: PCT/AU95/00678

§ 371 Date: Aug. 26, 1997

§ 102(e) Date: Aug. 26, 1997

[87] PCT Pub. No.: WO96/13698

PCT Pub. Date: May 9, 1996

[30] Foreign Application Priority Data

Oct. 26, 1994 [AU] Australia ..... PM 9015

[51] Int. Cl.[7] ..... F42B 3/00

[52] U.S. Cl. ..... 86/20.15; 102/313; 299/13

[58] Field of Search ..... 86/20.1, 20.15; 102/312, 313; 299/13

[56] References Cited

U.S. PATENT DOCUMENTS

| | | |
|---|---|---|
| 3,361,023 | 1/1968 | Collins et al. . |
| 3,610,088 | 10/1971 | Christensen et al. . |
| 3,943,820 | 3/1976 | Persson . |

FOREIGN PATENT DOCUMENTS

| | | | |
|---|---|---|---|
| 57045/90 | 12/1990 | Australia . | |
| 31997/93 | 7/1993 | Australia . | |
| 919918 | 1/1978 | Canada . | |
| 182661 | 5/1986 | European Pat. Off. . | |
| 612971 | 8/1994 | European Pat. Off. . | |
| 2204343 | 11/1988 | United Kingdom | 102/313 |

*Primary Examiner*—Harold J. Tudor
*Attorney, Agent, or Firm*—Pillsbury Madison & Sutro LLP

[57] ABSTRACT

An apparatus and process for the production of any emulsion explosives composition and loading it into a blast hole (7) which utilize a loading conduit (4) having a shear inducing means (5) and a liquid lubrication source (b) adapted to provide a layer of liquid lubricant between the conduit (4) and emulsion explosives composition being pumped through the loading conduit (4). The conduit also comprises a mixing means (8) located at or near the outlet of the conduit (4), the mixing means (8) incorporates at least some of the liquid layer into the emulsion explosives composition.

18 Claims, 2 Drawing Sheets

APPARATUS AND PROCESS FOR LOADING EMULSION EXPLOSIVES

Figure 1:
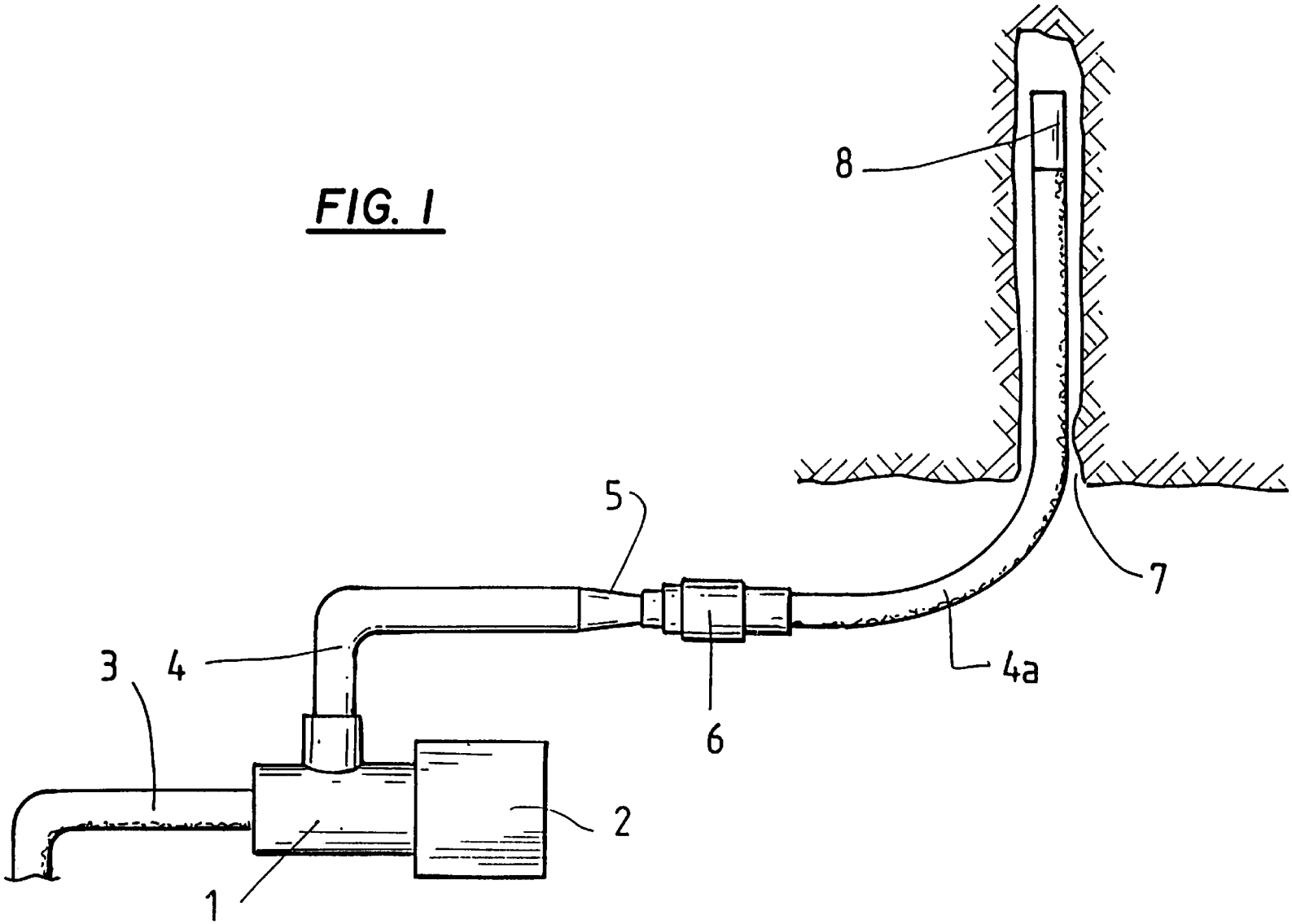

This invention relates to an apparatus and process for loading of water-in-fuel and melt-in-fuel emulsion explosives compositions. The invention is of particular use in loading emulsion explosive compositions of an optimal viscosity for retention in an uphole.

When explosives are used in the civilian blasting operations, rock is fractured by drilling blastholes then filling them with bulk or packaged explosive compositions which are subsequently detonated. Many blasting operations are carried out using water-in-fuel or melt-in-fuel emulsion explosives compositions. Water-in-fuel emulsion explosives compositions comprise a discontinuous phase of droplets of an oxygen supplying component such as an aqueous oxidiser salt solution dispersed in a continuous phase of organic fuels in the presence of one or more emulsifying agents. The oxygen-supplying continuous phase of a melt-in-fuel emulsion explosives composition comprises only a small proportion of water or adventitious water only. The discontinuous phase may be a eutectic composition, that is the melting point of the composition is either at the eutectic or in the region of the eutectic of the component salts of the discontinuous phase. Where used herein the term emulsion explosives composition refers to both water-in-fuel and melt-in-fuel emulsion explosives compositions.

Emulsion explosives compositions were first disclosed by Bluhm in U.S. Pat. No. 3,447,978. In U.S. Pat. No. 4,248,644, Healy describes an emulsion explosive composition wherein the oxidiser salt is added to the emulsion as a melt to form a melt-in-fuel emulsion explosives composition. They may also include various additives such as sensitising agents or agents to vary density including glass microballoons, plastic microballoons, expanded polystyrene beads or gas bubbles. Particulate oxidiser salts or mixtures of oxidiser salts plus fuel oil are often mixed into emulsion explosives compositions.

Where large quantities of bulk explosive are required they are often manufactured at a plant and transported in trucks to the blast site or alternatively they are manufactured on-site in small scale manufacturing units. These units are often designed to be mobile and some are located on trucks (called mobile manufacturing units or MMU's). The manufacturing units comprise (or are linked to) containers in which precursors of explosives compositions are stored separately until being mixed together in a mixing device of the manufacturing unit.

Following manufacture, explosive compositions must be loaded into blastholes. Some on-site manufacturing units comprise integral systems for delivery of bulk explosive compositions into blastholes. Blasthole loading is carried out by one of three main methods namely pouring, pumping or blow loading, the method used depending on the type of product and the ease of application.

In its simplest form, loading comprises merely tipping a receptacle containing explosives composition such that the composition is poured straight into a blasthole. Sometimes an auger is used to transport the composition from the receptacle to the collar of the blasthole where it drops under gravity down the hole. Conversely, blow loading uses large volumes of compressed gas to blow the explosive composition through a delivery hose into blastholes. Blow loading of explosives compositions has been used since the 1960's and is described in Australian Patent Nos. 441775 (Fox), 466558 (Persson), 469494 (Bizon & Simpson) and 474509 (Hay & Fox).

Possibly the most common method of loading bulk explosives compositions is to pump the compositions using mechanical or pneumatic means through a delivery hose into blastholes. Ideally an explosive composition is of low enough viscosity to be readily pumpable from a storage receptacle into blastholes. The higher the viscosity, the higher the pumping pressure required to move the explosive composition and the greater the strain put on the pump. If the viscosity is too high the pump may not be able to generate sufficient force to move the composition and/or it may begin to slip.

Conversely, if an emulsion explosives composition is of too low a viscosity, it tends to be lost by running into cracks and faults in the blasthole or be damaged by leaching with ground water. This is a particular problem in "downholes" which are blastholes which extend at an angle between horizontal and vertically downwards. Low viscosity compositions are also likely to suffer gravitational segregation of suspended particles from the liquid or semi-liquid phases. In some blasting operations such as underground mining it may be necessary for the emulsion explosives composition to be loaded into what are termed "upholes" which are blastholes which extend at an angle between horizontal and vertically upwards. The emulsion explosives composition used in upholes must be of sufficient viscosity that it forms a cohesive mass which sticks to itself and to the uphole walls and does not drop out under the effects of gravity.

In the past efforts have been made to load blastholes, particularly upholes, with explosives compositions of appropriate viscosity. However, the high pumping pressures needed to pump high viscosity emulsion explosives compositions has lead to shear crystallisation, emulsion separation and damage of certain components such as glass microballoons. Efforts have been made to reduce the pumping pressure required by injecting liquid between the pumped emulsion explosives composition and the inner surface of the hose or other loading conduit.

In the past attempts have been made to solve the problem of high pumping pressures for oil-in-water emulsion explosives compositions (known as "slurries") which were in common usage prior to water-in fuel and melt-in-fuel emulsion explosives composition explosives. For example, Australian patent application no. 15955/66 and U.S. Pat. No. 3,303,738 (Clay) describe chemical solutions to the pumping problem. Specifically a thickening agent was included in the slurry composition, the thickening action of the agent being delayed until the explosive composition is in the blast hole hence the slurry viscosity is low during pumping but later rises after it has left the loading hose.

Other more complicated mechanical approaches have been used provide emulsion explosives compositions which have low viscosity during pumping but which have increased viscosity in the blasthole. In Australian patent application no. 48979/85 (Miller) slurry compositions were pumped through a valve near the end of the blasthole loading hose, the valve imparting sufficient shear to increase slurry viscosity just prior to expulsion from the hose.

The present invention provides a system for use during pumping of emulsion explosive compositions which permits the emulsion explosives composition to be pumped at acceptable pressures, but which permits adjustment of emulsion explosives composition viscosity and is particularly useful where very high viscosity emulsion explosives compositions are necessary for uphole retention. The present invention therefore provides, a process for the loading of emulsion explosives compositions which process comprises the steps of;

(a) pumping an emulsion explosives composition past a shear inducing means located in a loading conduit;

(b) introducing a layer of liquid lubricant between said emulsion explosives composition and the conduit; and (c) pumping said emulsion explosives composition and liquid lubricant through a mixing means located at or near the outlet of said loading conduit;

wherein said mixing means incorporates at least some of said liquid lubricant into said emulsion explosives composition.

In a further aspect the present invention provides, an apparatus for the loading of emulsion explosives compositions comprising, a loading conduit having, a shear inducing means, a liquid lubrication source adapted to provide a liquid lubricant layer between said conduit and emulsion explosives composition explosives being pumped, and a mixing means located at or near the outlet of said loading conduit, which incorporates at least some of the layer of liquid lubricant into the emulsion explosives composition.

It has been found that it is particularly useful for the emulsion explosives composition to be subjected to the effects of the shear inducing means prior to introduction of liquid lubricant. Thickening emulsion explosives composition in the absence of a liquid lubricant causes less damage to the emulsion explosives composition and a relatively greater viscosity rise compared to the situation when liquid lubricant is present.

The shear inducing means may be of any convenient construction such as a valve, constriction or orifice in the conduit. The shear inducing means may form part of the source of liquid lubricant.

In a particularly preferred embodiment the shear inducing means comprises one or more orifices in the-conduit. Without wishing to be bound by theory it is believed that a droplet of the emulsion discontinuous phase approaching an orifice is subjected to a shear field, that is the leading edge of the droplet begins to move more quickly that the trailing edge of the droplet. This causes the droplet to elongate longitudinally and break up into several smaller droplets. The velocity gradient across the diameter of the orifices also causes a lateral shear field which breaks up the droplet. The smaller the aqueous droplets and the better dispersed the discontinuous phase of an emulsion explosives composition, the higher the viscosity of the composition.

Further viscosity increase can be achieved by provision of two or more orifices. The amount of shear imparted to the emulsion explosives composition and the subsequent viscosity increase can be affected by a number of factors including the number of orifices, their spacing, the length of the orifice, the orifice diameter and angle of lead in. In a particularly preferred embodiment the orifice(s) are circular, having a diameter of between 3 and 30 millimeters or oval, of maximum length between 3 and 30 millimeters. In order to provide sufficient lateral shearing of the emulsion it may be preferred that the emulsion flows through several orifices of decreasing diameter. The orifices may also be offset with respect to one another.

It is particularly preferred that the viscosity of the emulsion explosive composition is between 600,000 centipoise and 1,600,000 centipoise (Tf at 5 rpm with Heliopath at 20° C.) or more preferably between 800,000 centipoise and 1,000,000 centipoise as the composition leaves the loading hose following mixing by said mixing means.

The source of liquid lubricant may be any convenient means known in the art for introducing liquid to reduce friction or drag between a conduit and emulsion explosives composition passing there through. A simple injection device such as a water injection head may be a sufficient source of liquid lubricant.

The mixing means performs the function of moving the liquid lubricant from its position in the space between the emulsion explosives composition and the conduit, and mixing it through the emulsion explosives composition to form a homogeneous composition. This ensures that the emulsion explosives composition is able to form a cohesive unit in the blasthole, a feature that is important if the composition is to remain lodged in upholes without falling out. The mixing of liquid lubricant into the emulsion explosives composition will generally tend to reduce the emulsion explosives composition viscosity slightly hence it is necessary that the viscosity of the emulsion explosives composition in the conduit is slightly greater than the required in-hole viscosity.

The mixing means may comprise any device suitable for incorporating at least some of the liquid lubricant into the emulsion explosive composition. Static mixing elements may be suitable for mixing the liquid lubricant and emulsion composition. The mixing means may also comprise a means for separating a portion of the liquid lubricant so that it does not mix with the emulsion explosive composition. Preferably the means for separating some of the liquid lubricant is adjustable so that the amount of liquid lubricant mixed with the emulsion explosive composition can be varied to give products of different viscosities.

The mixing means may also provide for adjustment of the velocity at which the emulsion explosives composition is expelled from the end of the conduit so that an optimal velocity can be chosen at which the composition sticks in the toe of a blasthole rather than bouncing back out of the blasthole.

The conduit is adapted for passage of emulsion explosives composition from a storage container or the point of formation to the blasthole. It will frequently comprise a length of inflexible piping to which is attached a flexible hose which can be moved in and out of blastholes. In a particularly preferred embodiment the conduit comprises a flexible hose, and the shear inducing means and fluid lubrication source are located at or near the inlet of the hose while the mixing means is located at or near the outlet of the hose. The process and apparatus of the current invention can be used for loading of upholes and downholes of any appropriate diameter and length; in underground applications the blasthole diameter may be of between 50 and 200 millimeters diameter while in aboveground applications the blasthole diameter may be up to 300 millimeters or more.

The explosive composition for use in system of the current invention may be any emulsion explosives composition suitable for delivery by pumping but preferably comprises an emulsion. Particulate matter such as particulate oxidiser salts may be mixed with the emulsion explosives composition but only if the particles are sufficiently small or in a form in which they do shear inducing shear inducing means or mixing means.

It is preferred that the oxidiser salt for use in the discontinuous phase of the emulsion explosives composition is selected from the group consisting of ammonium and alkali and alkaline earth metal nitrates and perchlorates and mixtures thereof. Typically the discontinuous phase of the emulsion explosives composition comprises 60 to 97% by weight of the composition and preferably 86 to 96% by weight of the composition.

The continuous water-immiscible phase of the emulsion explosives composition comprises an organic fuel. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes (e.g. microcrystalline wax, paraffin wax and slack wax), paraffin oils, benzene, toluene, xylenes, asphaltic materials, polymeric oils such as low molecular weight polymers of olefins, animal oils, fish oils, vegetable oils and other mineral hydrocarbon or fatty oils and mixtures thereof. Oils such as canola oil, olive oil, peanut oil, sunflower oil, corn oil, coconut oil, palmkernel oil, cottonseed oil, safflower oil, and soyabean oil have been found particularly useful for promoting rapid viscosity increase. Typically the continuous water-immiscible fuel phase of the emulsion explosives composition comprises between 3 and 50% by weight of the emulsion explosives composition and preferably from 4 to 15% by weight of the emulsion explosives composition.

The emulsifier component of emulsion explosives compositions suitable for use in the system of the current invention may be any suitable emulsifier known in the art. For example the emulsifier may comprise one or more derivatives of poly[alk(en)yl] succinic anhydride species or sorbitan monooleate or mixtures thereof. The preferred level of the emulsifier component used is in the range of from 0.4 to 5.0% by weight of the emulsion explosives composition.

If desired optional additional fuel materials may be mixed into the emulsion explosives composition but preferably these do not make the explosive composition too oxygen negative. Examples of such secondary fuels include finely divided materials such as sulphur, aluminium, carbonaceous materials such as gilsonite, comminuted coke or charcoal, carbon black, resin acids such as abietic acid, sugars such as glucose or dextrose and other vegetable products such as starch, nut meal, grain meal and wood pulp and mixtures thereof. Finely divided materials may only be mixed with the emulsion explosives composition if they are sufficiently finely divided or in a form which does not block the shear inducing means or mixing means. Typically the option additional fuel materials are used in an amount up to 30% by weight based on the weight of the emulsion explosives composition.

Void agents may be added to the emulsion explosives composition to form a discontinuous phase which may vary the density and/or sensitivity of the composition. The void agent may comprise a discontinuous gaseous phase; the gaseous phase may for example, be incorporated into the emulsion explosive composition as fine gas bubbles dispersed through the composition as hollow particles which are often referred to as microballoons or microspheres, as porous particles (e.g. perlite) or mixtures thereof. The discontinuous phase of void agents may be incorporated into the explosive composition by mechanical agitation, injection or bubbling the gas through the composition or by chemical generation of gas in situ.

A discontinuous gaseous phase may also be formed by mixing a gas precursor into the emulsion explosive composition. The gas precursor may for example be a nitrite and/or a thiocyanate or any other of the precursors which are well known in the art. Gas forming precursors may be introduced into the process of the current invention at any convenient stage. For example gas forming precursors may be injected into the emulsion explosives composition prior to or after the composition has passed through the shear inducing means or before or after the liquid layer is provided. Additional mixing elements such as static mixing elements may be provided in the loading conduit to evenly distribute the gas forming precursor in the emulsion explosives composition. The gas forming precursor reacts to form a dispersed phase of fine bubbles.

In a preferred embodiment the liquid lubricant of the current invention comprises a gas forming precursor which becomes distributed in the emulsion explosive composition when the mixing means incorporates at least some of the liquid lubricant into the emulsion explosive composition. The liquid lubricant may for example comprise a nitrite and/or thiocyanate species dissolved in water or incorporated as a component of a microemulsion.

Alternatively the emulsion explosive composition may comprise the gas forming precursor while the liquid lubricant comprises one or more chemical species which react with the gas forming precursor. The chemical species may for example act to initiate or increase the rate or efficiency of formation of gas bubbles. In a preferred embodiment the gas forming precursor is a nitrite and/or a thiocyanate mixture while the chemical species is ammonium nitrate.

The liquid lubricant of the current invention may comprise a pure liquid, solution, emulsion or the like. Water is a particularly inexpensive and effective lubricating fluid. Various additives may be dissolved or mixed in the liquid lubricant to alter its characteristics or the properties of the emulsion explosive composition when some of the liquid lubricant is mixed into the composition. For example the additives may comprise one or more chemical species dissolved or mixed in the liquid lubricant to improve its lubricating characteristics, viscosity, flow characteristics, freezing point and the like. The additives may also improve the pumping characteristics of the emulsion explosives composition or the sensitivity of the composition to detonation.

In a further aspect the current invention also provides a method of blasting comprising loading an emulsion explosive composition into a blasthole by the process described hereinabove such that the explosives composition is in operative contact with an initiating system including a detonator and primer, then initiating said detonator and thereby said emulsion explosive.

It will be readily apparent that the process of the current invention can be utilised not only to load blastholes, but also to load cartridges, packages, bags or other receptacles in which it may be desired to store explosives compositions. For example the process of the current invention may be used to fill cartridges in the production of packaged emulsion explosives.

Figure 2:
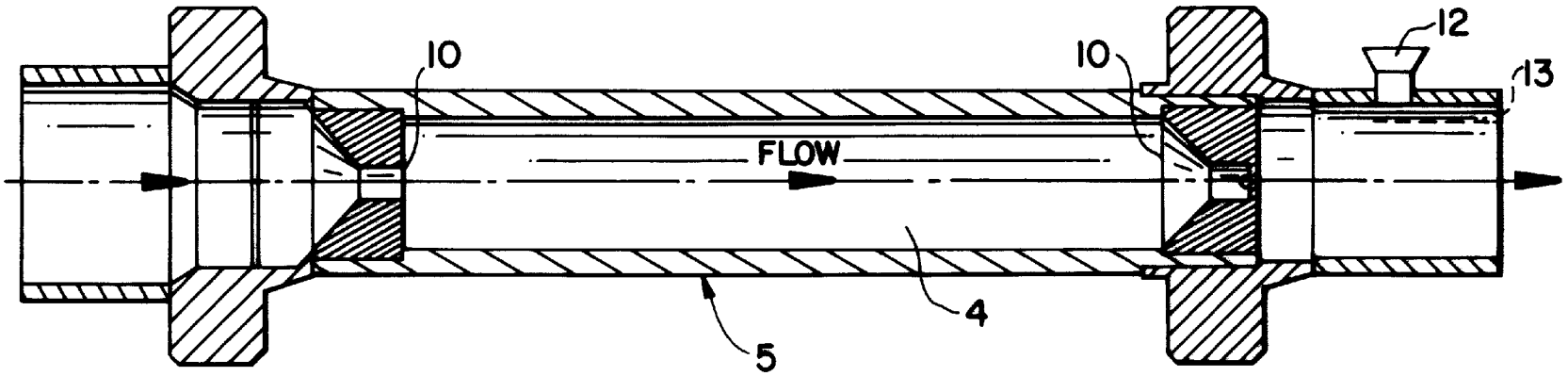

An embodiment of the process of the current invention will be further described by reference to the following drawings wherein FIG. 1 is a plan drawing of a system for loading explosives and FIG. 2 shows a representative shear inducing means comprising two spaced orifices.

The drawing of FIG. 1 shows a pump (1) driven by an air motor (2) into which emulsion explosive composition may be fed by a pipe (3). The pump feeds the emulsion explosives composition into a conduit (4) comprising a flexible hose **(4*a*). The emulsion explosives composition is pumped through shear inducing means i.e. an orifice (5) which imparts shear and thus increases the viscosity of the emulsion explosives composition. The composition then passes through a water injector (6) imparting an annular stream of water around the emulsion explosives composition, lubricating its flow through the flexible hose. The hose extends along an uphole (7) and just prior to the emulsion explosives composition leaving the hose, a mixing device (8)** mixes the water into the emulsion explosives composition to form a homogeneous product which fills the blasthole in a cohesive mass which does not flow appreciably during the sleep time between loading and firing.

FIG. 2 shows a representative shear inducing means (5) comprising two spaced orifices (10), which are circular or oval, positioned within conduit (4). The emulsion explosives composition is subjected to shear as it flows through the orifices. This functions to increase the viscosity of the composition before lubricant is introduced between the conduit and the composition.

FIG. 2 also shows an injection device means (12) for supplying liquid lubricant in annular fashion between the conduit and emulsion explosives composition. The lubricant flows along the inner surface of the conduit as shown at (13) until the mixing means (8).

The current invention will be further explained with reference to the following examples;

EXAMPLE 1(a)

Two vertical upholes of 115 millimeters diameter and 12 meters in length were toe-charged to within one meter of the collar using the system depicted in FIG. 1 and an emulsion explosives composition based on POWERGEL 2500UB underground bulk emulsion explosives composition. (POWERGEL is a registered trade mark of ICI Australia Operations Proprietary Limited). The viscosity of the emulsion explosives composition in-hole was 980,000 centipoise (Tf at 5 rpm with Heliopath at 20° C.). The blastholes had slightly greasy walls due to the presence of emulsion explosives composition from previous tests but they were otherwise quite dry. The holes were inspected periodically over a three month period with no product loss or leakage being detected.

EXAMPLE 1(b)

Twenty four dry upholes of between 59 and 90° inclination, 115 mm diameter and lengths ranging between 3 and 20 meters were loaded with emulsion explosives composition according to the method described in Example 1(a). No product loss or leakage was detected in the three day sleep time between loading and blasting. All holes detonated successfully.

EXAMPLE 1(c)

Thirty nine holes of between 50 and 70° inclination, 76 mm diameter and up to 22 meters in length were loaded with emulsion explosives composition according to the method described in Example 1(a). The holes varied from having a damp appearance through to continually trickling water down their walls. The product retention in the upholes was not as good in the wet holes as compared with the dry holes.

EXAMPLE 1(d)

Twelve holes of 45° incline, 76 mm diameter and 10 meters in length were loaded with emulsion explosives composition according to the method described in Example 1(a). All holes were wet and most had water trickling down their walls. The emulsion explosives composition used comprised relatively high amounts of emulsifier and oil, that is 5% by weight emulsifier and 30% by weight vegetable oil. The product viscosity was 1,180,000 centipoise (Tf at 5 rpm with Heliopath at 20° C.). Retention of the emulsion explosives composition was monitored over several days with no loss of product being observed.

EXAMPLE 1(e)

Fifty-one 108 millimeter diameter upholes of between 50 and 90° C. inclination, and up to 50 meters in length were charged with the emulsion composition of Example 1(e). The holes were dry to damp with some being open or in broken ground. Product thickening was good, with minimal loss of product during charging. The product remained in the holes for several days prior to firing.

Examples 1(a), 1(b), 1(c), 1(d) and 1(e) show that a sufficiently viscous emulsion explosives composition formed by the process of the present invention will not flow appreciably during its sleep life in dry holes. In extremely wet holes the adhesion is not quite as good as in dry holes; this is not unexpected as it is clearly difficult to make an oily substance such as an emulsion adhere to a wet surface. However slight variation of the emulsion explosives composition can improve the adherence.

While the invention has been explained in relation to its preferred embodiments it is to be understood that various modifications thereof will become apparent to those skilled in the art upon reading the specification. Therefore it is to be understood that the invention disclosed herein is intended to cover such modifications as fall within the scope of the appended claims.

We claim:

1. A process for the loading of emulsion explosives compositions which process comprises the steps of:

(a) pumping an emulsion explosives composition past a shear inducing means located in a loading conduit so as to increase the viscosity of the emulsion explosives composition;

(b) subsequently introducing a layer of liquid lubricant between said emulsion explosives composition and the conduit; and (c) pumping said emulsion explosives composition and liquid lubricant through a mixing means located at or near the outlet of said loading conduit;

wherein said mixing means incorporates at least some of said liquid lubricant into said emulsion explosives composition and wherein the shear inducing means comprises two or more successive orifices.

2. A process according to claim 1 wherein said shear inducing means comprises a valve, constriction or orifice in said conduit.

3. A process according to claim 1 wherein the orifices are circular and between 3 and 30 millimeters in diameter.

4. A process according to claim 1 wherein the orifices are oval and have a maximum length of between 3 and 30 millimeters.

5. A process according to claim 1 wherein the viscosity of the emulsion explosives composition is between 600 000 centipoise and 1 600 000 centipoise upon exit from the mixing means.

6. A process according to claim 1 wherein the viscosity of the emulsion explosives composition is between 800 000 and 1 000 000 centipoise upon exit from the mixing means.

7. A process according to claim 1 wherein the mixing means comprises one or more static mixing elements.

8. A process according to claim 1 wherein the liquid lubricant is a pure liquid, solution or emulsion.

9. A process according to claim 8 wherein the liquid lubricant comprises a gas forming precursor or additive for altering the characteristics of the liquid lubricant or the properties of the emulsion explosive composition.

10. A process according to claim 1 wherein the emulsion explosives composition is loaded into a blasthole.

11. A process according to claim 10 wherein the blasthole is an uphole.

12. A process according to claim 1 wherein the emulsion explosives composition is loaded into a cartridge, bag, package or other receptacle for the packaging of emulsion explosives compositions.

13. A method of blasting comprising loading an emulsion explosive composition into a blasthole by a process according to claim 1 such that the explosives composition is in operative contact with an initiating system including a detonator and initiating said detonator and thereby said emulsion explosives composition.

14. An apparatus for the loading of emulsion explosives composition comprising, a loading conduit having, a shear inducing means comprising two or more successive orifices, a liquid lubrication source positioned downstream from said shear inducing means to provide a layer of liquid lubricant between said conduit and emulsion explosives composition being pumped through the loading conduit, and a mixing means located at or near the outlet of said loading conduit, which mixing means incorporates at least some of the layer of liquid lubricant into the emulsion explosives composition.

15. An apparatus for the loading of emulsion explosives composition according to claim 14 wherein said shear imparting means comprises a valve, constriction or orifice in said conduit.

16. An apparatus according to claim 14 wherein the orifices are circular and between 3 and 30 millimeters in diameter.

17. An apparatus according to claim 14 wherein the orifices are oval and have a maximum length of between 3 and 30 millimeters.

18. An apparatus according to claim 14 wherein the mixing means comprises one or more static mixing elements.

* * * * *